US007273312B1

(12) United States Patent
Birchler

(10) Patent No.: US 7,273,312 B1
(45) Date of Patent: Sep. 25, 2007

(54) NIGHT LIGHT DISPLAY HANGER

(76) Inventor: Wilfred J. Birchler, 165 Center St., Ashburnham, MA (US) 01430

( * ) Notice: Subject to any disclaimer, the term of this patent is extended or adjusted under 35 U.S.C. 154(b) by 75 days.

(21) Appl. No.: 11/334,010

(22) Filed: Jan. 18, 2006

(51) Int. Cl.
*H01R 33/00* (2006.01)

(52) U.S. Cl. ..... 362/644; 362/351; 362/355

(58) Field of Classification Search ..... 362/641, 362/644, 652, 653, 351, 353, 355; 40/554; 248/231.85
See application file for complete search history.

(56) References Cited

U.S. PATENT DOCUMENTS 442,629 A * 12/1890 Lipscomb ..... 248/231.85
2,997,576 A 8/1961 Heitshu
3,092,695 A 6/1963 Abrams
3,290,817 A * 12/1966 Kravath ..... 446/227
4,549,250 A 10/1985 Spector
4,714,984 A 12/1987 Spector
4,878,162 A 10/1989 Wu
4,912,609 A 3/1990 Gillette
5,622,424 A 4/1997 Brady
5,887,802 A 3/1999 Yousefzadeh
6,631,999 B1 * 10/2003 Chang ..... 362/96
6,776,505 B1 8/2004 DeWitt

* cited by examiner

*Primary Examiner*—Ali Alavi
(74) *Attorney, Agent, or Firm*—Clock Tower Law Group; Erik J. Heels; Joshua D. Mather

(57) ABSTRACT

A night light has an hook for interchangeably receiving artistic stained glass ornaments to be displayed in front of a light source. The night light improves the aesthetic benefits of stained glass using night lights.

6 Claims, 12 Drawing Sheets

NIGHT LIGHT DISPLAY HANGER

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. Copyright 2005-2006 Switchables.

CROSS REFERENCE TO RELATED APPLICATIONS

None.

FIELD OF THE INVENTION

The invention relates to lighting devices. More specifically, the invention relates to stained glass covers for night lights.

BACKGROUND OF THE INVENTION

The conventional night light comprises of an electrical assembly having an electrical socket integrated with a plug for insertion into a wall receptacle. A low wattage lamp (generally 2 to 4 watts) is held in the socket and a small translucent shade is usually provided to shield the lamp from direct view. A night light of this type normally uses a low wattage lamp which provides low level illumination.

Conventional night lights are releasably plugged into electrical wall outlets. Accordingly, they provide a dim light in the immediate vicinity of the wall outlet. Such night lights typically comprise a small incandescent bulb, having power output of around 2 to 4 watts, a movable hood or shade.

Night lights which can be plugged into wall electrical receptacles are normally used to provide low level illumination in a dark room or hallway. When used in a bedroom, a night light can provide sufficient light to allow a person to move about the room without colliding into objects and still provide an ideal environment for sleeping. Night lights are also desirable for young children who are fearful of complete darkness.

Night lights have become a mainstay for many homes, and as such, there have been many ornamental improvements to the conventional night light. Most ornamental improvements to night lights consist of a night light housing formed in the shape of an object pleasing to the eye. For example, a flower, vegetables, farm animals and so forth. The light shines through the shaped housing to dimly illuminate a room.

A problem with existing night light housings is that they are typically made of translucent plastic, which can discolor and fade over time. In some cases, users may insert a bulb into the socket that is a higher watter than the socket is rated for, and in this case, some night light housings can blacken or even burn.

Another problem with existing night light housings is that they tend to disengage from the electrical assembly, becoming damaged or lost in the process. Existing night light housings snap onto the electrical assembly. Such a configuration allows the user to switch night light housings, installing different housings onto the electrical assembly when desired, but, in this configuration, such housings tend to disengage from the electrical assembly.

Existing night lights do not provide a night light with (1) a durable translucent housing that does not readily discolor or fade, (2) changeable housing feature that allows the user to quickly change the housing used. What is needed, therefore, is a night light that overcomes the above-mentioned limitations and that includes the features enumerated above.

BRIEF SUMMARY OF THE INVENTION

A night light comprising an electrical assembly having blade contacts for insertion into an electrical receptacle, a light receptacle for receiving a source of illumination, and a power switch for toggling power to the light receptacle; a stem attached to an annular groove of the electrical assembly; the stem extending generally vertically from the electrically assembly to a vertical point approximately above the source of illumination; the stem extending generally horizontally from the vertical point to a horizontal point approximately beyond the source of illumination; the stem having an ornament connector at the horizontal point for releasably receiving an ornament, wherein an attached ornament appears in front of the source of illumination.

A night light adapter, comprising a generally vertical arm having a lower section and an upper section; the lower section having a night light connector for attaching to a convention night light such that the arm is approximately behind a light source of the conventional night light; and the upper portion extending over the light source of the conventional night light, the upper portion having an ornament connector at an end of the upper portion, wherein an ornament attached to the ornament connector is positioned generally in front of the light source.

A night light ornament holder for holding stained glass ornaments comprising a conventional night light having electrical contacts, a power switch, a light receptacle for receiving a light source, and an annular ring surrounding the light receptacle; an ornament holder having a base, a stem, and a hanger; the base connected to the annular ring, the stem extending from the base generally vertically to a point above a light source positionable in the light receptacle; the hanger extending over the light source; and a stained glass ornament hung from the hanger, wherein at least a portion of the stained glass ornament hangs approximately in front of the light source.

A method of assembling a night light ornament holder comprising attaching an arm to the housing portion of a night light, wherein the arm extends vertically above and in front of a light source on the night light, the arm having an ornament connector for receiving an ornament, wherein an attached ornament hangs in front of the light source thereby serving as an attractive night light.

DETAILED DESCRIPTION OF THE INVENTION, INCLUDING THE PREFERRED EMBODIMENT

In the following detailed description of the invention, reference is made to the accompanying drawings which form a part hereof, and in which are shown, by way of illustration, specific embodiments in which the invention may be practiced. It is to be understood that other embodiments may be used, and structural changes may be made without departing from the scope of the present invention.

Figure 1:
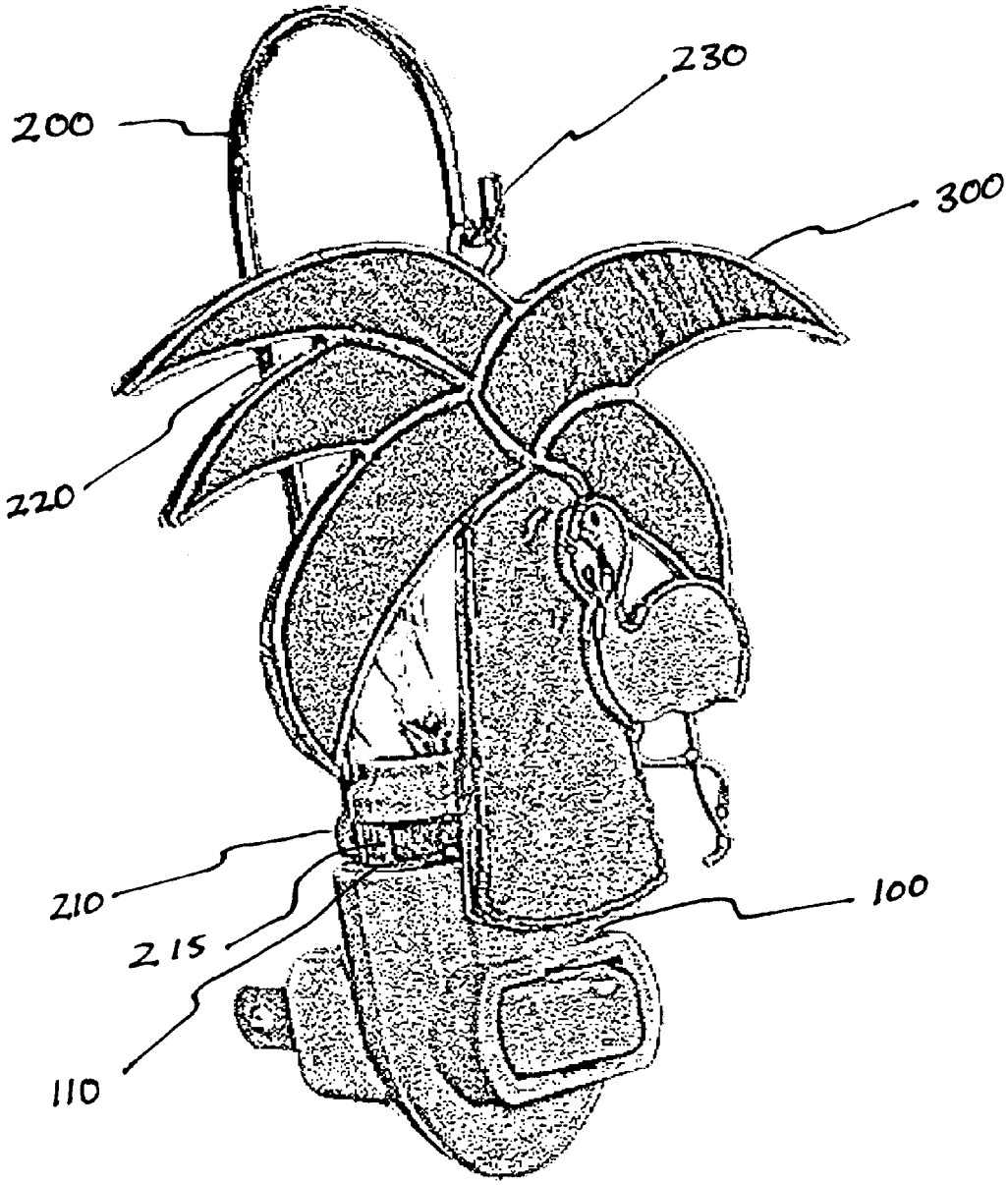
FIG. 1 is a front perspective view of the preferred embodiment of the invention.

Referring now to FIG. 1, which is a front perspective view of the preferred embodiment of the invention. An electrical assembly 100 is fitted with a hanger 200, and the hanger 200 includes a base 210, stem 220, and connector 230. The connector 230 is adapted to receive an ornament 300. In the preferred embodiment, the electrical assembly 100 is an off-the-shelf night light fixture, such as a night light fixture that uses low wattage incandescent light bulbs.

Figure 2:
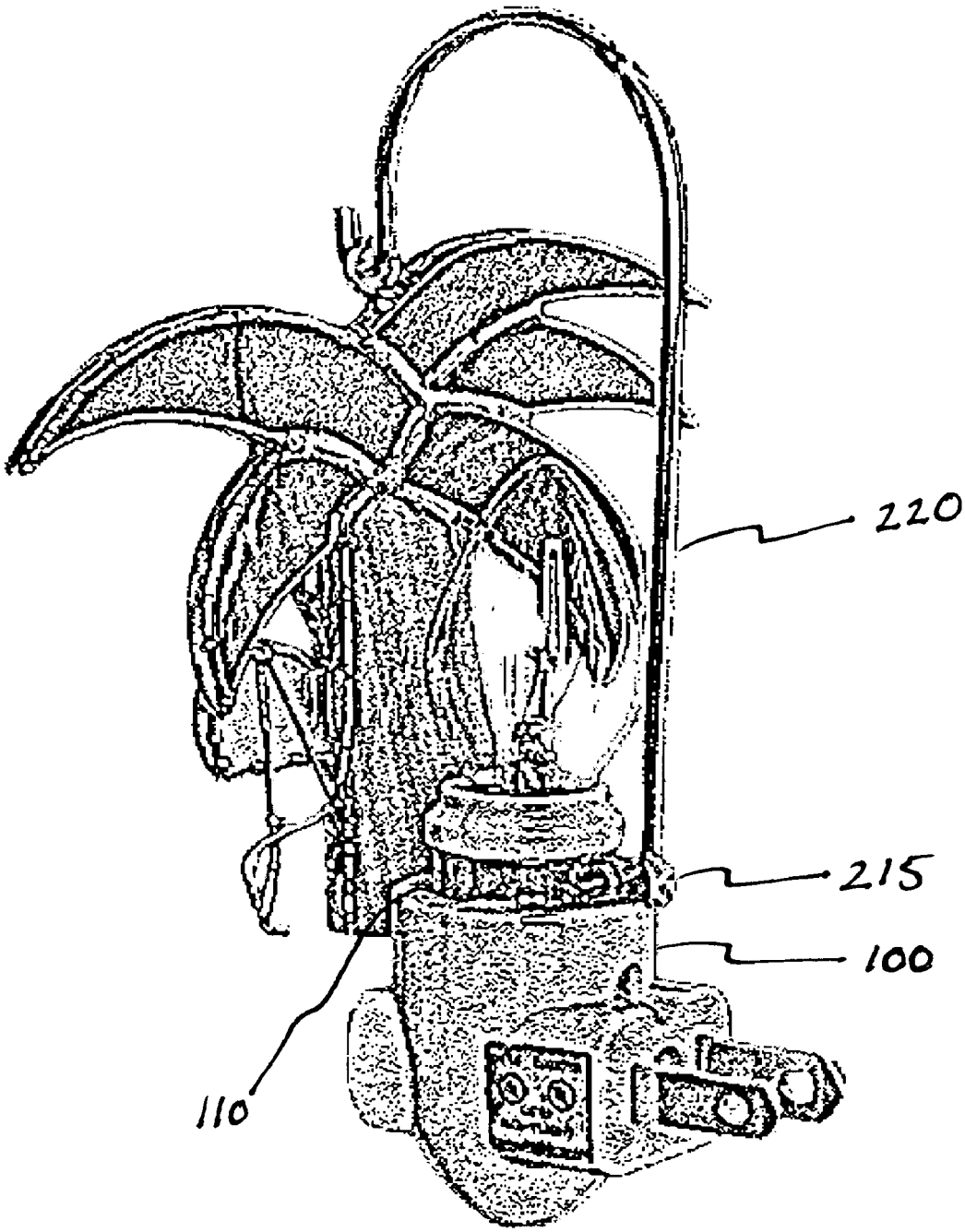
FIG. 2 is a rear perspective view of the preferred embodiment of the invention.

Referring now to FIG. 2, which is a rear perspective view of the preferred embodiment of the invention. The base 210 includes a circular clasp 215 that wraps around the electrical assembly 100. The base 210 is connected to the stem 220 at the rear of the electrical assembly 100.

Figure 3:
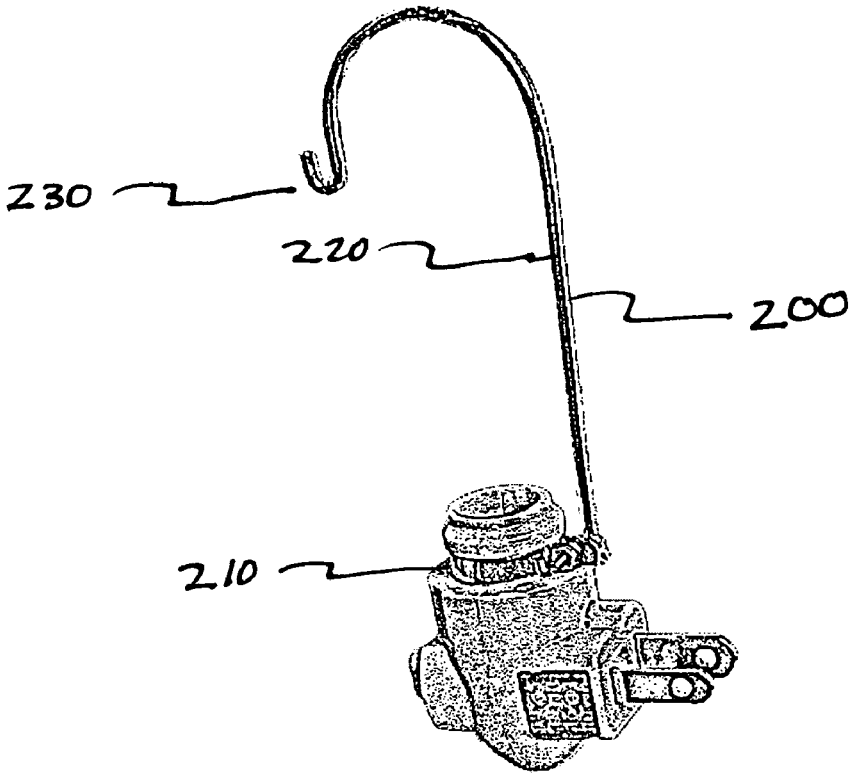
FIG. 3 is a rear perspective view of the preferred embodiment of the invention, shown without the ornament and without the bulb.
Figure 4:
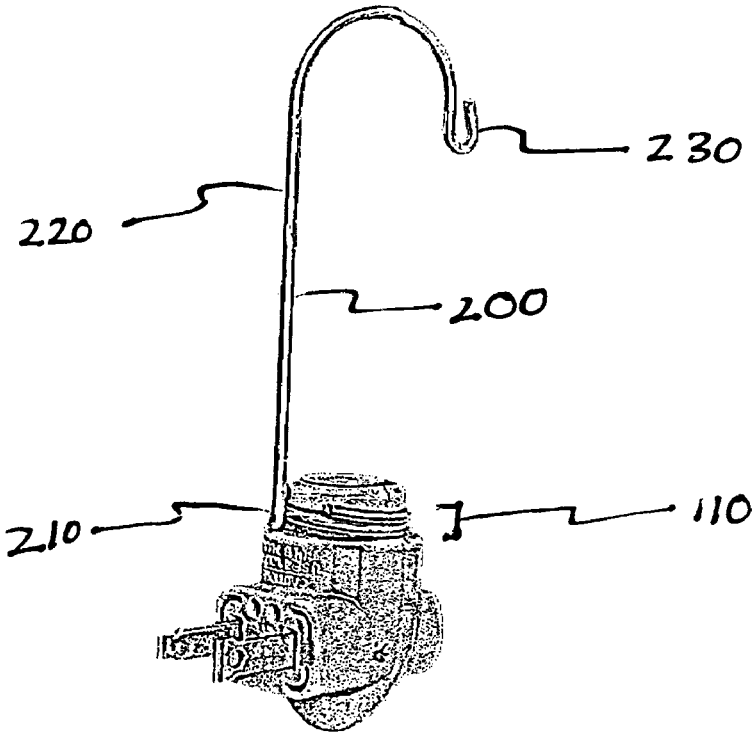
FIG. 4 is a rear perspective view of an other embodiment of the invention, shown without the ornament and without the bulb.

Referring now to FIG. 3 and FIG. 4, which are rear perspective views different embodiments of the invention, shown without the ornament 300 and without the bulb. In FIG. 4, one embodiment is shown in which the hanger 200 is made from a single piece of 13-gage metal, shaped to form the base 210, stem 220, and connector 230. The base 210 is attached to the electrical assembly 100 by wrapping the 13-gage metal around the external annular groove 110 of the electrical assembly. The embodiment of FIG. 3 is the preferred embodiment because it requires less metal than the embodiment of FIG. 4, can be assembled more quickly, and can be manufactured less expensively.

Figure 5:
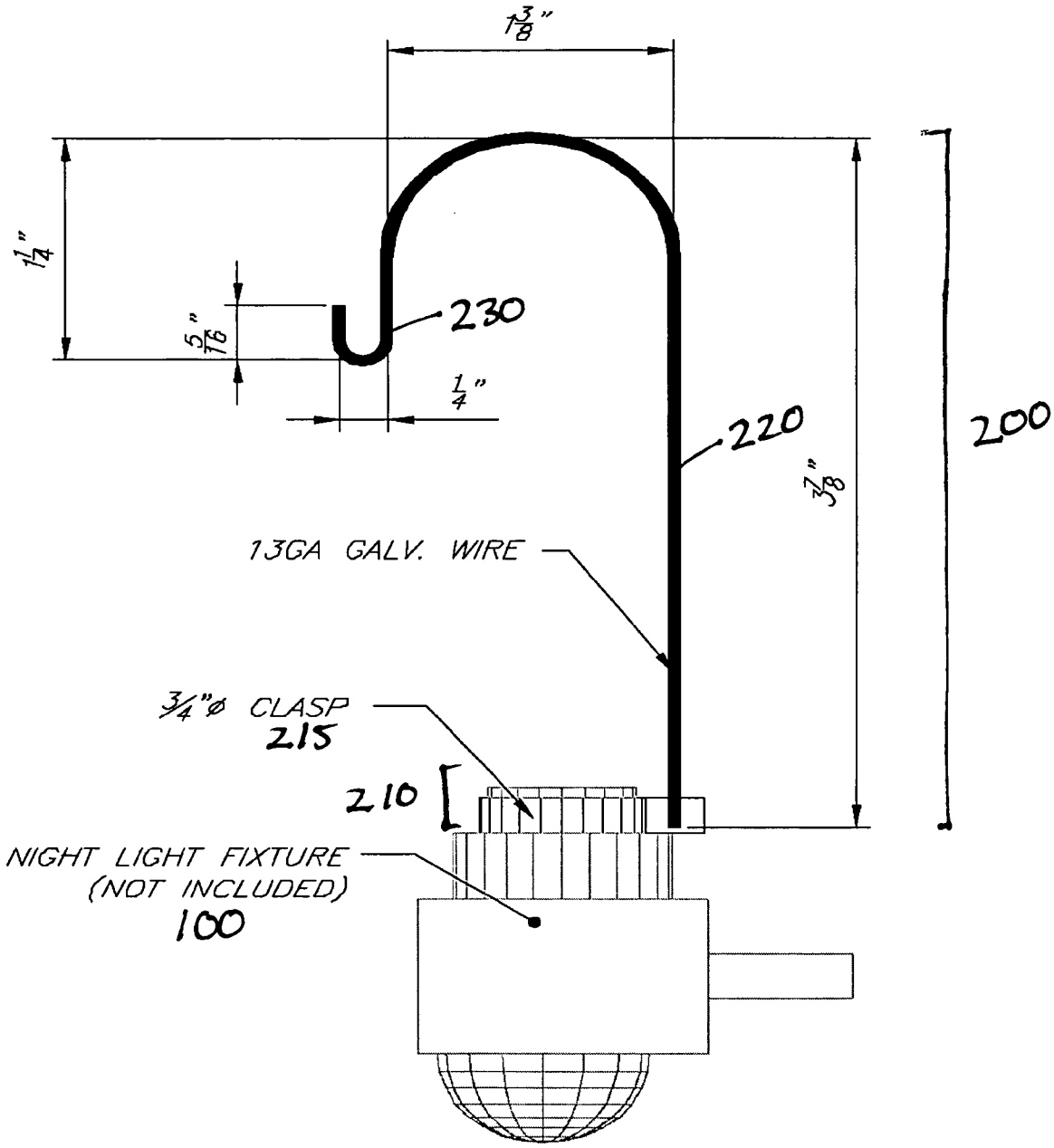
FIG. 5 is a side view of the preferred embodiment of the invention, shown without the ornament and without the bulb.

Referring now to FIG. 5, which is a side view of the preferred embodiment of the invention, shown without the ornament 300 and without the bulb. FIG. 5 shows the preferred embodiment in more detail. A ¾ inch diameter clasp 215 is wrapped around the electrical assembly 100. For electrical assemblies that include an external annular groove 110, the clasp 215 can be attached to the electrical assembly 100 so that the clasp 216 sits inside the external annular groove 110. At the rear of clasp 215 (at the right in FIG. 5), the clasp 215 is attached to the stem 220. In the preferred embodiment, the clasp 215 is soldered to the stem 220, the clasp 215 includes two small holes (not shown) at either end, and the clasp 215 is additionally secured by a nut and bolt (not shown), the bolt placed through the holes of the clasp 215 and secured to the nut.

Continuing now with FIG. 5. The connector 230 is a hook formed from the piece of 13-gage metal that is also used for the stem 220. The connector 230 is shaped to receive an ornament 300, which, when the night light is fully assembled, hangs from the hook in front of the light bulb.

Figure 6:
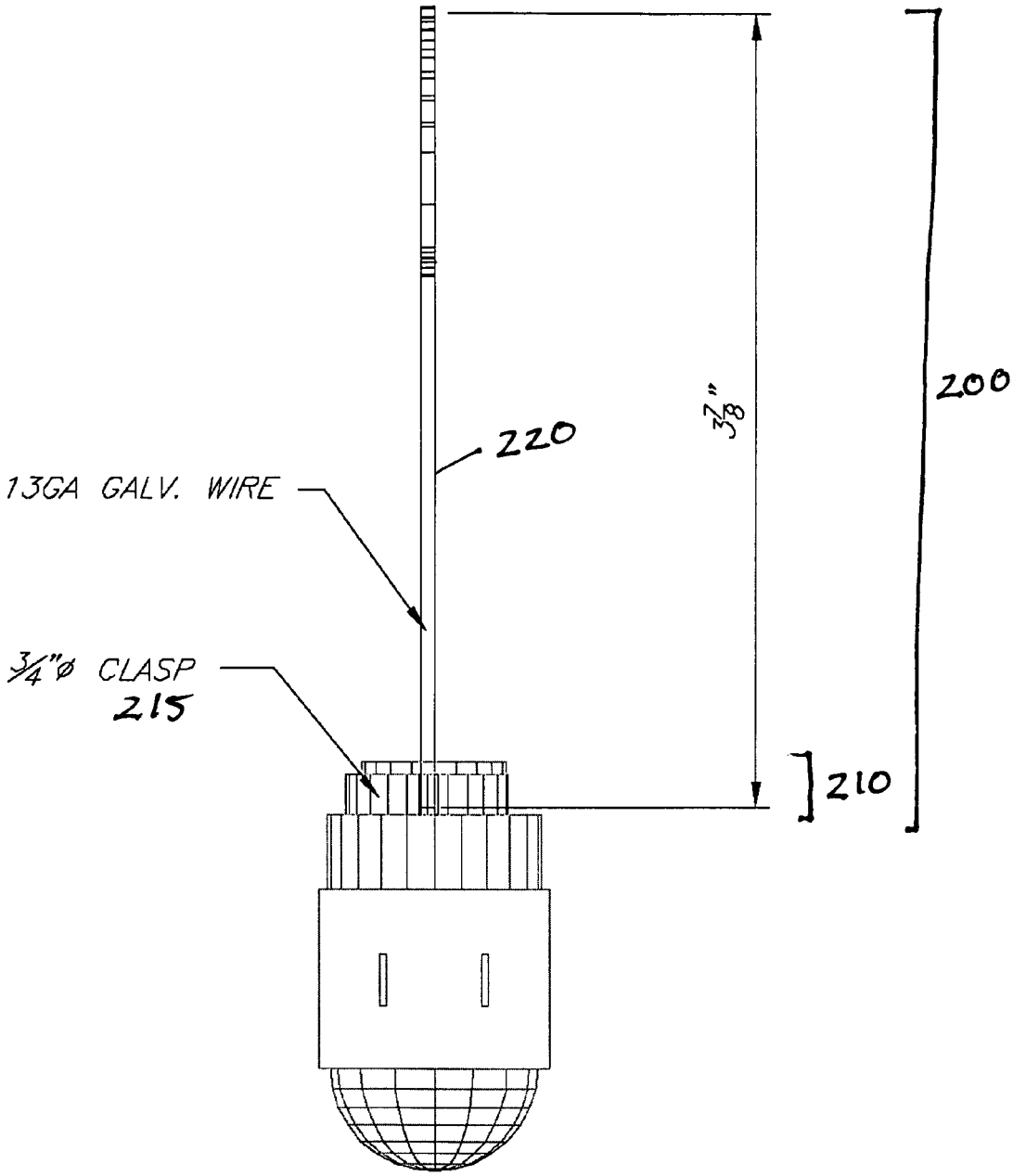
FIG. 6 is a rear view of the preferred embodiment of the invention, shown without the ornament and without the bulb.
Figure 7:
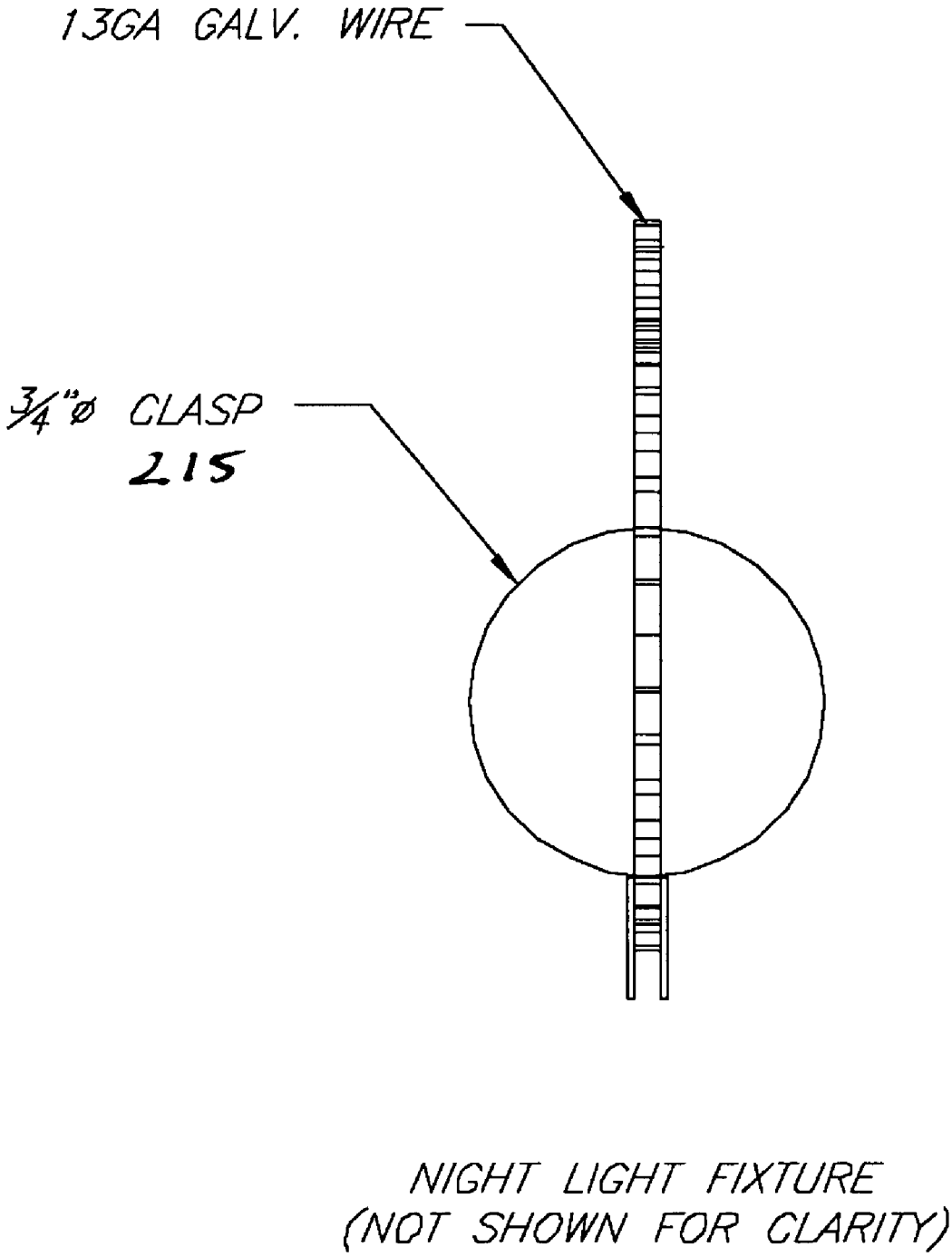
FIG. 7 is a top view of the preferred embodiment of the invention, shown without the ornament and without the electrical assembly.

FIG. 6 is a rear view of the preferred embodiment of the invention, shown without the ornament 300 and without the bulb. FIG. 7 is a top view of the preferred embodiment of the invention, shown without the ornament 300 and without the electrical assembly 100.

FIGS. 8-13 shows several examples of ornamental designs for the night light ornaments 300.

OTHER EMBODIMENTS

The dimensions shown above are for the preferred embodiment of the invention, but different dimensions can be used without departing from the scope of the invention.

The base 210 can be attached to the electrical assembly by a clasp 215 (as shown in FIG. 3) or by a single piece of metal (as shown in FIG. 4), by tape, or by any other means.

The hanger 200 can be a single or multiple piece unit made of piece of metal, plastic, wood, or any other suitable material. Injection molding can be used to make the electrical assembly 100 and the hanger 200 a single piece of plastic. Similar methods can be used to make the electrical assembly 100 and the hanger 200 a single piece of metal.

The clasp 215 can be secured to the electrical assembly 100 by a nut and bolt, a screw, slots and grooves, solder, glue, or otherwise.

Figure 8:
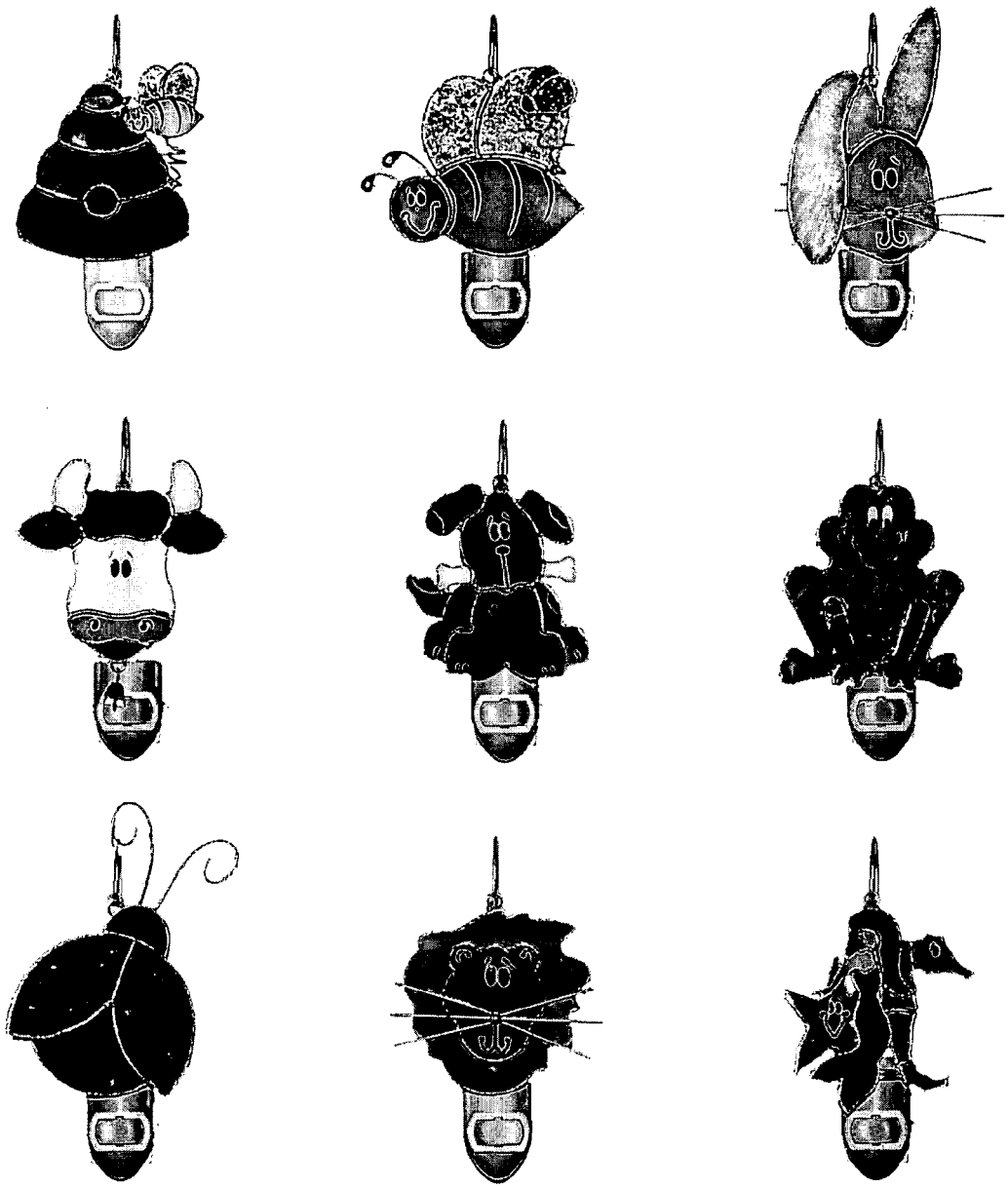
FIGS. 8-13 shows several examples of ornamental designs for the night light ornaments.
Figure 9:
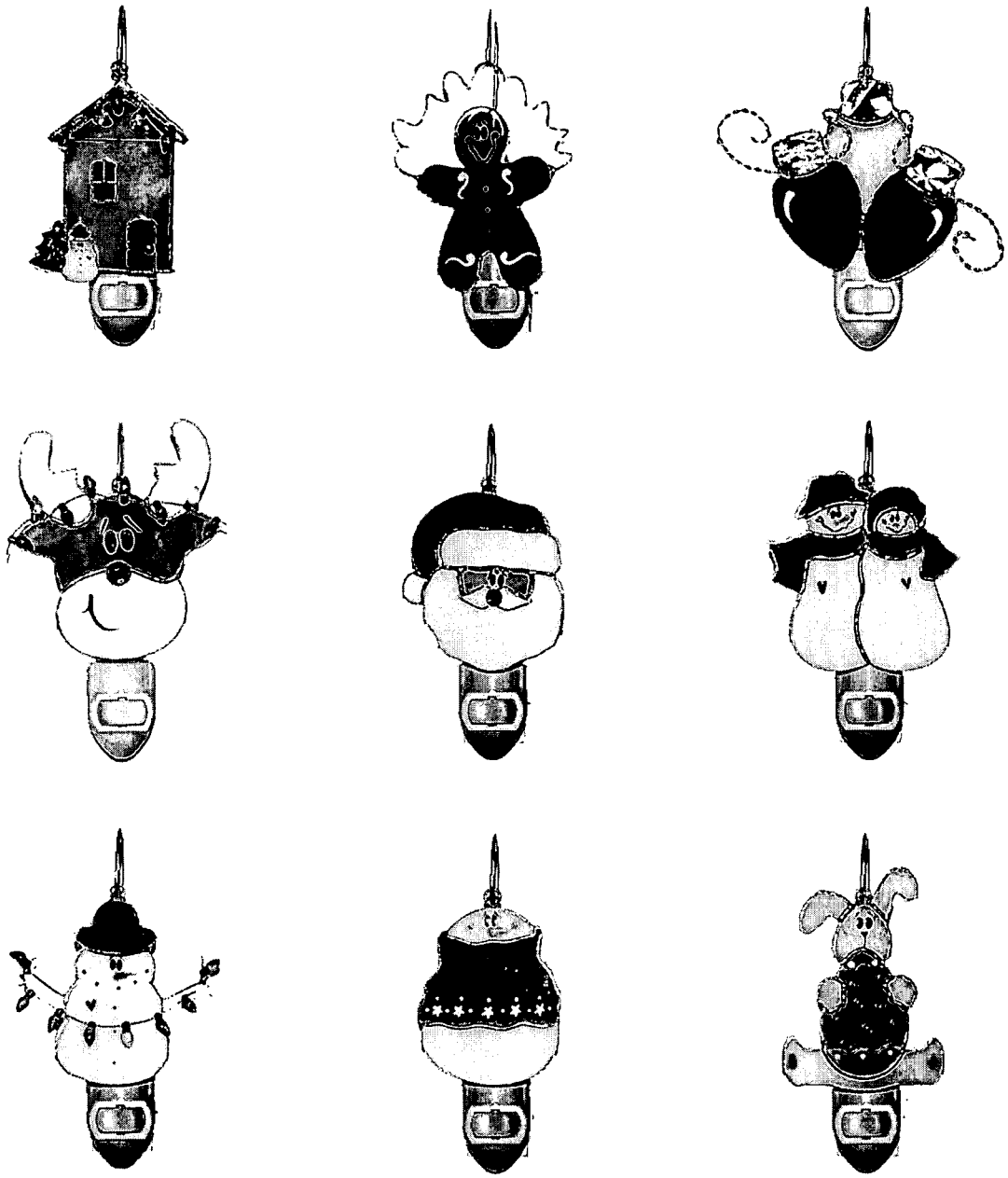
Figure 10:
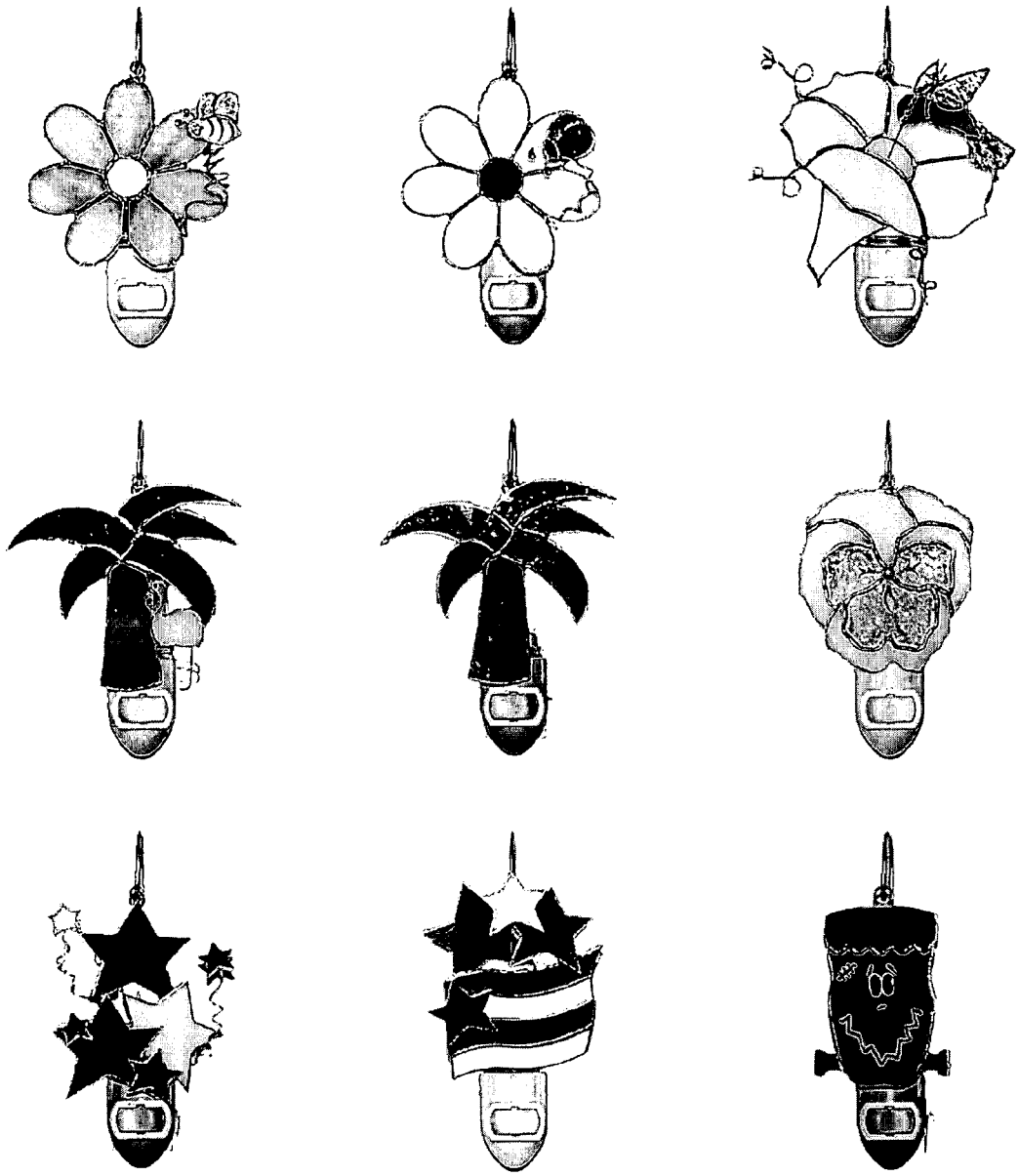
Figure 11:
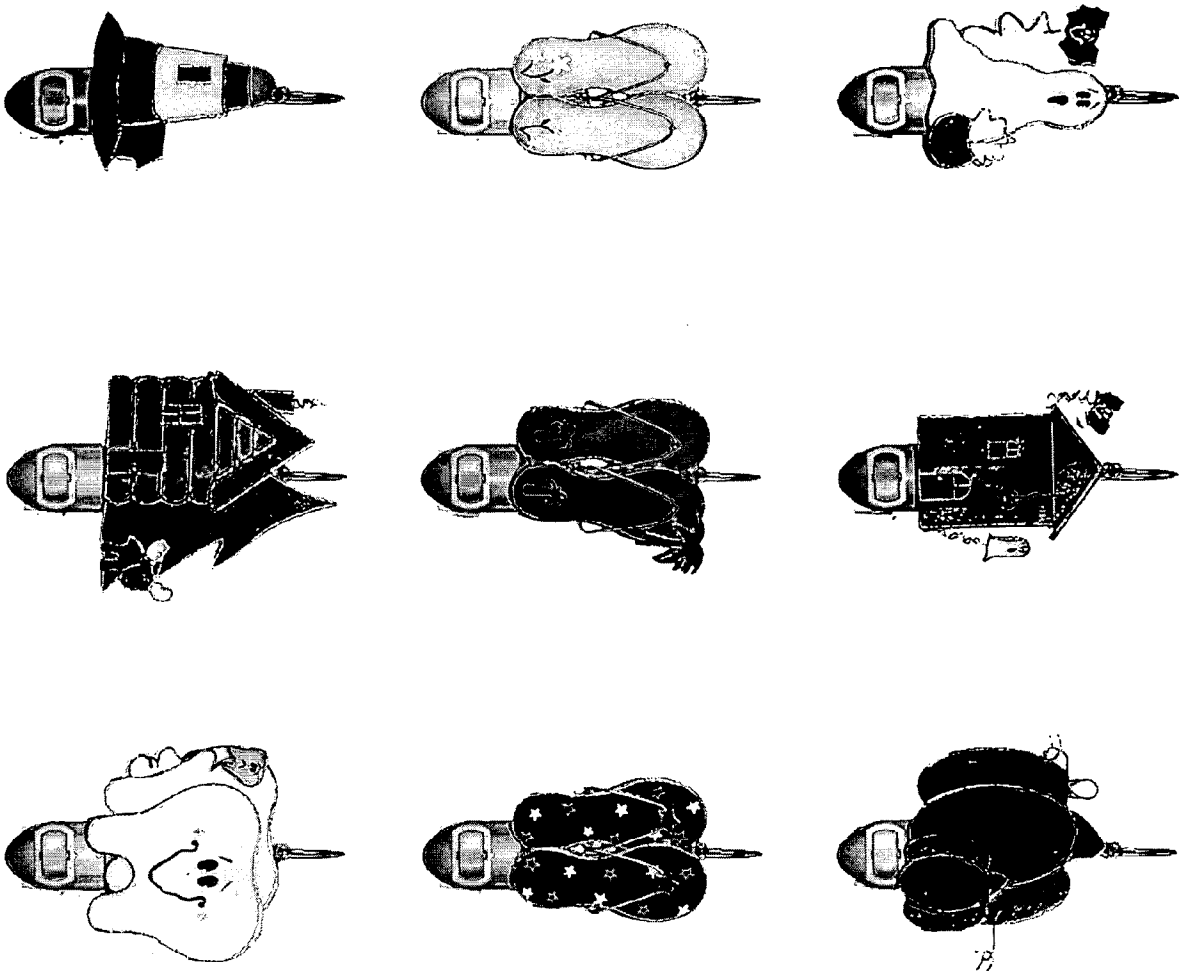
Figure 12:
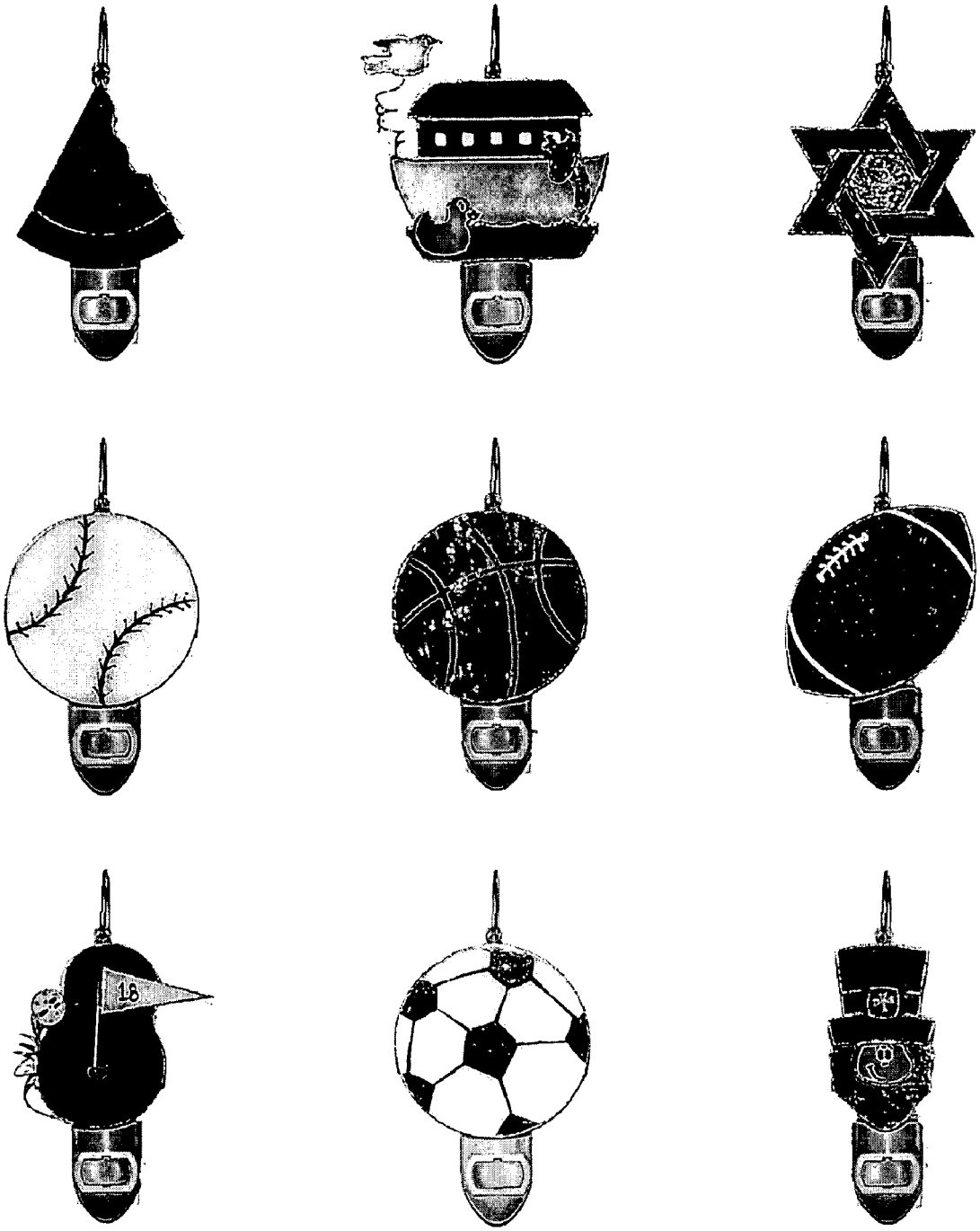
Figure 13:
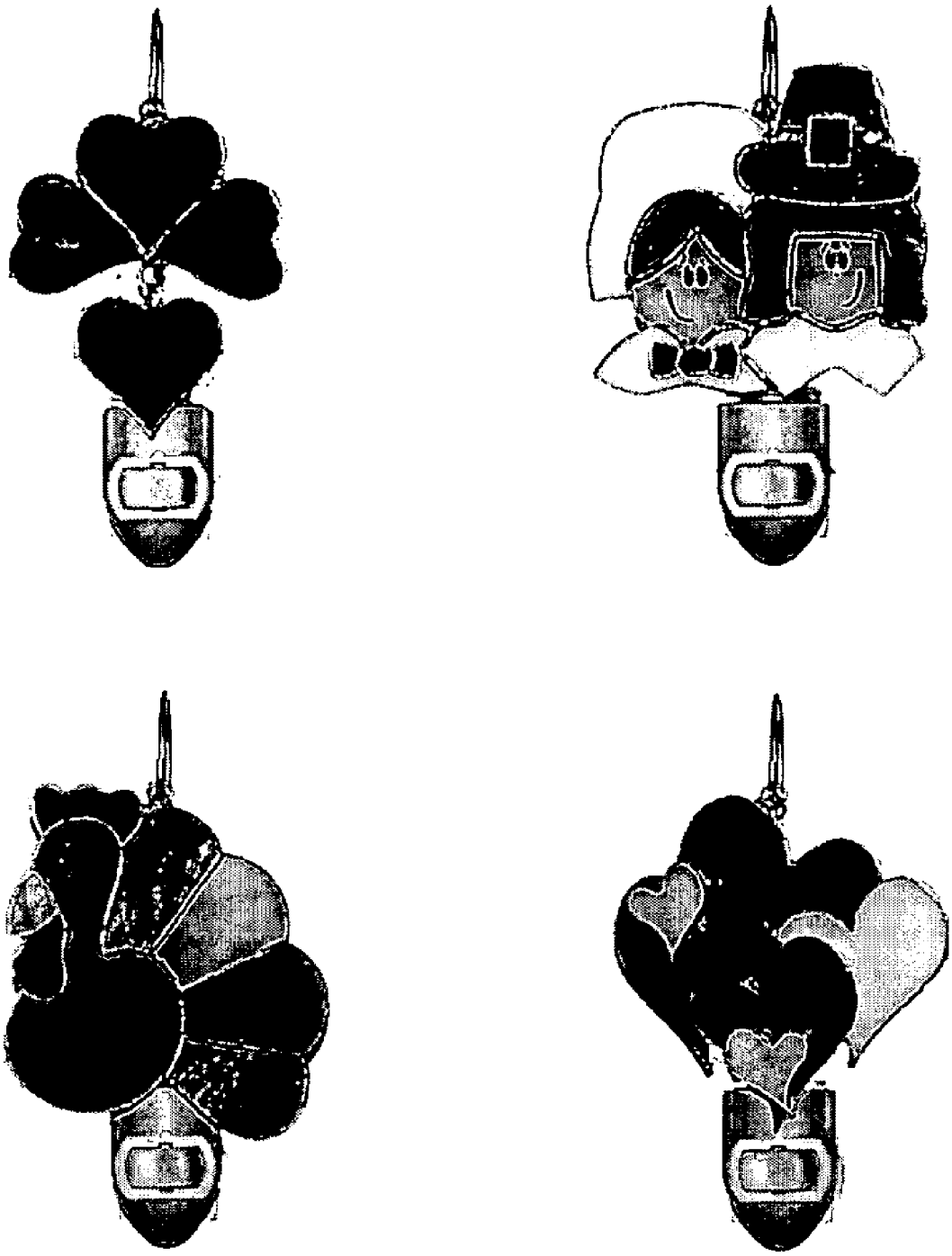

Any number of translucent ornaments 300 may be positioned in front of the night light. Preferably the ornaments are made of stained glass and shaped artistically. FIGS. 8-10 shows several examples of ornamental designs for the night light ornaments.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

The invention claimed is:

1. A night light comprising:

an electrical assembly having blade contacts for insertion into an electrical receptacle, a light receptacle for receiving a source of illumination, and a power switch for toggling power to the light receptacle;

a stem attached to an annular groove of the electrical assembly;

the stem extending generally vertically from the electrically assembly to a vertical point approximately above the source of illumination;

the stem extending generally horizontally from the vertical point to a horizontal point approximately beyond the source of illumination;

the stem having an ornament connector at the horizontal point for releasably receiving an ornament, wherein an attached ornament appears in front of the source of illumination.

2. The night light of claim 1, wherein the source of illumination is selected from the group consisting of: an incandescent bulb a reflector for directing light generally forward, at least one LED lamp, an LED panel, and an electroluminescent panel, and an OLED panel.

3. A night light adapter, comprising:

a generally vertical arm having a lower section and an upper section;

the lower section having a night light connector for attaching to a convention night light such that the arm is approximately behind a light source of the conventional night light; and the upper portion extending over the light source of the conventional night light, the upper portion having an ornament connector at an end of the upper portion, wherein an ornament attached to the ornament connector is positioned generally in front of the light source.

4. The night light adapter of claim 3, wherein the arm releasably attaches to the convention night light.

5. A night light ornament holder for holding stained glass ornaments comprising:

a conventional night light having electrical contacts, a power switch, a light receptacle for receiving a light source, and an annular ring surrounding the light receptacle;

an ornament holder having a base, a stem, and a hanger;

the base connected to the annular ring, the stem extending from the base generally vertically to a point above a light source positionable in the light receptacle;

the hanger extending over the light source; and a stained glass ornament hung from the hanger, wherein at least a portion of the stained glass ornament hangs approximately in front of the light source.

6. A method of assembling a night light ornament holder comprising:

attaching an arm to the housing portion of a night light, wherein the arm extends vertically above and in front of a light source on the night light, the arm having an ornament connector for receiving an ornament, wherein an attached ornament hangs in front of the light source thereby serving as an attractive night light.

* * * * *